US012589925B2

(12) United States Patent
Van Hoeck et al.

(10) Patent No.: US 12,589,925 B2
(45) Date of Patent: Mar. 31, 2026

(54) CONTAINER WITH VALVE

(71) Applicant: Party IP Holdings LLC, Orlando, FL (US)

(72) Inventors: Jade Van Hoeck, Waasmunster (BE); Sara L. Delgado Carmona, Orlando, FL (US); Nathalie De Beer, Herzele (BE); Dimitri M.C.J. Backaert, Moorsel (BE); Ine M.K. Vandaele, Baardegem (BE); Alec Vercruyssen, Aalst (BE); Ryan Clavecillas, Brussels (BE)

(73) Assignee: Party IP Holdings LLC, Orlando, FL (US)

( * ) Notice: Subject to any disclaimer, the term of this patent is extended or adjusted under 35 U.S.C. 154(b) by 0 days.

(21) Appl. No.: 18/783,816

(22) Filed: Jul. 25, 2024

(65) Prior Publication Data

US 2026/0028166 A1 Jan. 29, 2026

(51) Int. Cl.
*B65D 51/16* (2006.01)
*B65D 43/02* (2006.01)

(52) U.S. Cl.
CPC ..... *B65D 51/1644* (2013.01); *B65D 43/0202* (2013.01); *B65D 2205/025* (2013.01); *B65D 2543/00101* (2013.01)

(58) Field of Classification Search
CPC ..... B65D 43/0202; B65D 2205/025; B65D 2543/00101; B65D 51/1644; B65D 51/1633; B65D 51/1683; B65D 77/225
See application file for complete search history.

(56) References Cited

U.S. PATENT DOCUMENTS

| | | | | |
|---|---|---|---|---|
| 4,448,325 | A | 5/1984 | Edwards et al. | |
| 6,053,474 | A | 4/2000 | Stucke, Jr. et al. | |
| 9,624,013 | B2 * | 4/2017 | Sebben | B65D 41/165 |
| 2009/0200296 | A1 * | 8/2009 | Iwasaki | B29C 45/33 220/254.2 |

(Continued)

OTHER PUBLICATIONS

EP Application No. 25195952.4, Extended European Search Report dated Dec. 3, 2025; Applicant Dart Industries Inc.; 8 pages.

*Primary Examiner* — Don M Anderson

(57) ABSTRACT

A food or beverage container with a valve. The valve is defined by an aperture in the one of the base or cover, and a valve element including an elastic panel. The panel has a first section secured to the cover by an elastic mounting tab which extends through the cover and is secured thereto. The elastic panel has an undeformed position spaced from the aperture such that the valve open condition is the default condition. The panel may be manually moved to a deformed position to close the aperture by a plug. This plug may include a shaft having an enlarged head, with the elastic nature of the panel ensuring forced contact and creating the valve closed condition. The elastic nature of the panel is tuned to allow the plug to be drawn inward during under-pressure with the container. This inward movement will break contact of the enlarged head a valve vent condition. With the interior of the container so vented and under-pressure reduced, the elastic nature of the panel will again move the plug outward to the valve closed condition. In this way the valve may automatically regulate pressure within the container during cooling.

6 Claims, 6 Drawing Sheets

(56) References Cited

U.S. PATENT DOCUMENTS

| | | | | |
|---|---|---|---|---|
| 2015/0060446 | A1 | 3/2015 | Park | |
| 2015/0284155 | A1* | 10/2015 | Stamper | B65D 43/0222 220/315 |
| 2016/0031616 | A1* | 2/2016 | Rye | B65D 51/1616 220/303 |
| 2016/0031617 | A1* | 2/2016 | Faucheaux, Jr. | B65D 51/1683 251/231 |
| 2016/0107808 | A1* | 4/2016 | Forsyth | B65D 51/1633 220/253 |
| 2017/0107026 | A1* | 4/2017 | Scott | B65D 43/0225 |
| 2021/0206544 | A1* | 7/2021 | Holka | B32B 7/08 |
| 2021/0206549 | A1* | 7/2021 | Kim | B65D 53/02 |
| 2021/0354891 | A1* | 11/2021 | Netter | G06V 40/166 |

* cited by examiner

CONTAINER WITH VALVE

CROSS REFERENCE TO RELATED APPLICATIONS

Not applicable.

STATEMENT REGARDING FEDERALLY SPONSORED RESEARCH

Not applicable.

BACKGROUND OF THE INVENTION

The present invention relates in general to food or beverage storage containers, and in particular those containing vents.

It is common for food or beverage containers to employ vents which are selectively openable or closable. These vents take the general form of an aperture in the container wall, combined with a vent element to selectively close the aperture. In the closed position, the vent element seals the container and will prevent the free exchange of air within the container to atmosphere. This may be desirable for a variety of reasons, such as reducing spoilage by limiting oxygen, retaining food odor within the container, preventing spilling from the container, etc. Conversely, in the open position the vent element will allow free exchange of air within the container. This too may be desirable for a variety of reasons, such as reducing build-up of gasses which accelerate food spoilage, allowing egress of steam and pressure during reheating, or allowing ingress of air during cooling to prevent under-pressure.

It has been known to provide such vent elements in a variety of forms. Semi-rigid toggle elements have been used, oscillating between open and closed positions. It is also known to provide valve elements which include an elastic panel which may be manually deformed from a closed position to an open position.

SUMMARY OF THE INVENTION

An object of the present invention is to provide a food container having a vent employing a vent element including an elastic panel.

Another object of the present invention is to provide an vent element which has an improved connection to the food container.

A further object of the present invention is to provide an elastic panel having an undeformed position corresponding to the open valve condition, and a deformed position corresponding to the closed valve condition.

Yet another object of the present invention is to provide an elastic panel which, in an under-pressure situation, may be moved from an initial deformed condition corresponding to the valve closed condition to a secondary deformed position corresponding to a valve vent condition.

These and other objects are achieved by a container with valve. The container includes a base to hold food, and a cover to close the container. At least one of the base and cover includes a valve. The valve is defined by an aperture in the one of the base or cover, and a valve element including an elastic panel.

The panel has a first section secured to the base or cover adjacent the aperture. This may be effected by an elastic mounting tab on the panel which extends through the base or cover and is secured thereto on a side opposite the panel.

The panel has a second section which may overlie the aperture. The elastic panel has an undeformed position in which this second section is spaced from the aperture such that the valve open condition is the default condition. The panel may be manually moved to a deformed position to close the aperture.

The panel may include a plug which closes the aperture and holds the second section in the deformed position. This plug may include a shaft having an enlarged head. This enlarged head may have a full periphery to contact and seal against an interior of the container adjacent the aperture, with the elastic nature of the panel ensuring forced contact and creating the valve closed condition.

The plug may further be formed with the shaft having a smaller diameter allowing reciprocation within the aperture, and with the elastic nature of the panel tuned to allow the plug to be drawn inward during underpressure with the container. This inward movement will break contact of the enlarged head with the container and create the valve vent condition. With the interior of the container so vented and under-pressure reduced, the elastic nature of the panel will again move the plug outward to the valve closed condition. In this way the valve may automatically regulate pressure within the container during cooling.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
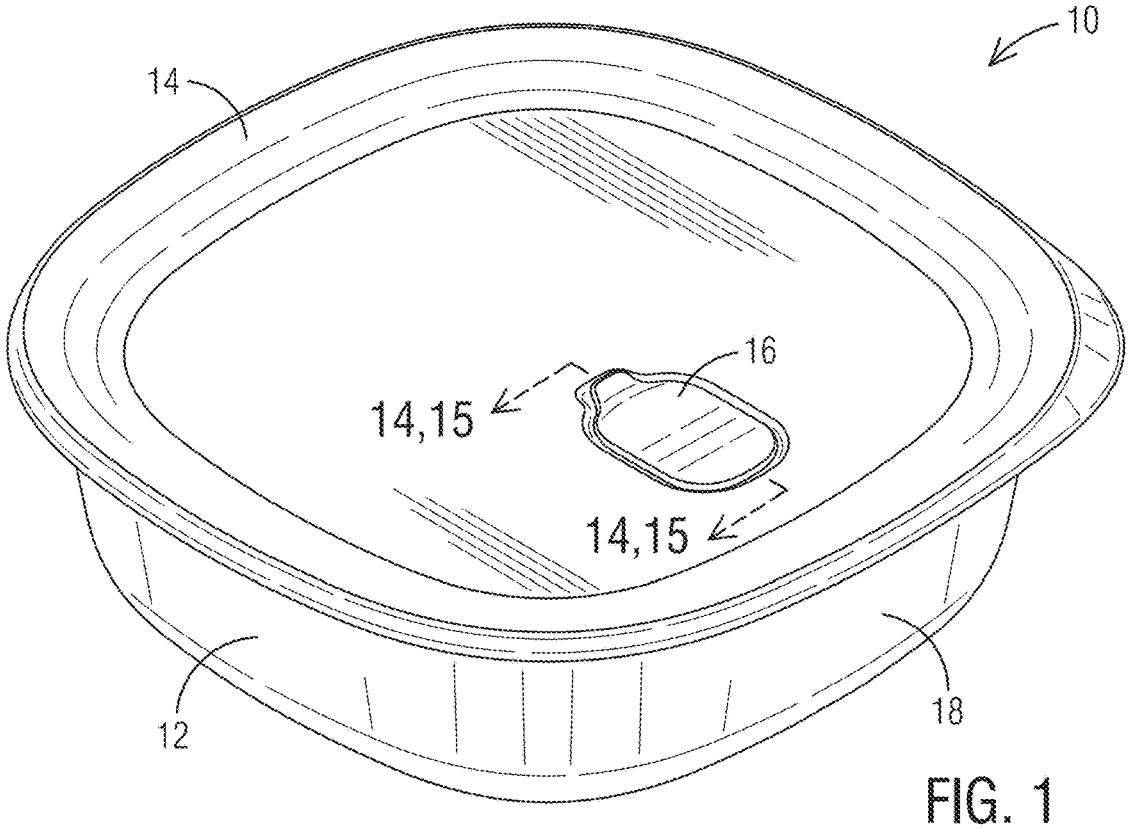
FIG. 1 is a top perspective view of the food container with valve according to the present invention in the valve element in the closed position.

With reference to FIG. 1, a food container with valve according to the present invention is generally designated by reference numeral 10. The container 10 generally includes a base 12, a cover 14, and a valve element 16. As illustrated, the container 10 has a general peripheral form of a square when viewed from above. This is for illustration only, and the container 10 could be formed as a round periphery, oval, rectangular, triangular, or any other polygon desired. When used for beverages, a round periphery is typically preferred for container 10.

The base 12 is generally concave to hold food or beverage therein, and generally includes a bottom wall (not shown) having one or more sidewalls 18 extend upward to a rim. As illustrated, the base 12 is wide and shallow as is preferred for food storage. It may be readily envisioned that base 12 may be formed narrow and deep if instead used for beverage storage.

Figure 12:
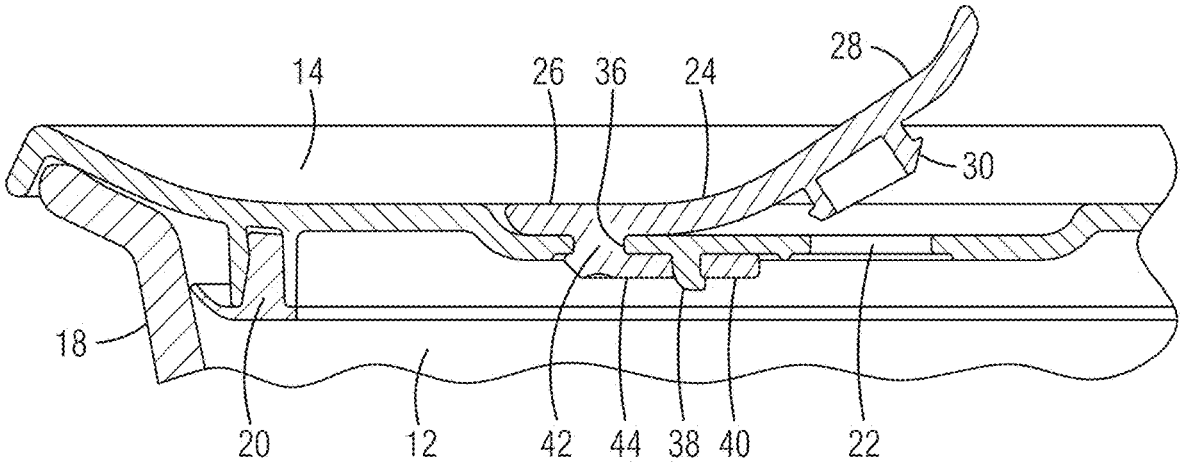
FIG. 12 is a cross-sectional view of the valve in the open condition along line 12-12 of FIG. 2.

The cover 14 is intended to rest upon and enclose the rim of base 12 to create an interior volume to retain the food or beverage in a closed and secure manner. The cover 14 often takes a generally planar form to allow stacking of multiple containers 10, but may be concave or convex as desired. The need for a vent in the container 10 indicates that the cover 14 will be secured to the base 12 in a water-tight and/or air-tight manner. This may be achieved in a number of ways known in the art. The cover 14 may secure directly to the rim of base 12 without intermediary elements. In the embodiment shown, and intermediary gasket 20 is secured to the cover 14 adjacent it's periphery and this gasket 20 will engage with the interior of base sidewall 18 adjacent the rim, as illustrated in FIG. 12.

The container 10 further includes an aperture 22 extending therethrough and allowing fluid communication between the interior of container 10 and atmosphere. This aperture 22 could be formed in either the sidewall 18 or in the cover 14, as is known in the art. In the embodiment shown, the aperture 22 is formed through the cover 14. The aperture 22 may take various geometric shapes such as circular, triangular, oval, or others. The aperture 22 is formed as circular in the embodiment shown.

With particular reference to FIGS. 6-11, the valve element 16 includes a main panel 24 which may take numerous forms: circular, rectangular, elongated oval or others. In the embodiment shown, the main panel 24 is generally rectangular. Regardless of the form, the main panel 24 will include a first section 26 secured to the exterior of container 10 (here, the exterior of cover 14) and a second section 28 adapted to overlie the aperture 22. The first section 26 is spaced from the second section 28. A feature of the present invention is that the main panel 24 is formed of an elastic material, preferable silicone.

The first section 26 of main panel 24 may be secured to the container 10 in various ways known in the art. The container 10 (either base 12 or cover 14) could have an outwardly extending prong (not shown) having a press fit within an aperture (not shown) in the main panel 24. Or the reverse arrangement could be provided with the main panel 24 having the prong extending through the container 10, or any other arrangement known in the art.

The first section 26 is secured to the container 10 at a position such that when so secured the second section 28 will be capable of overlying the aperture 22. In general, the valve element 16 is intended to selectively open or close the aperture 22. This may be achieved in any way known in the art. In the preferred embodiment shown, this selective closure of aperture 22 is effected by forming a plug 30 extending from the interior face of second section 28 at a position to enter the aperture 22.

Figure 13:
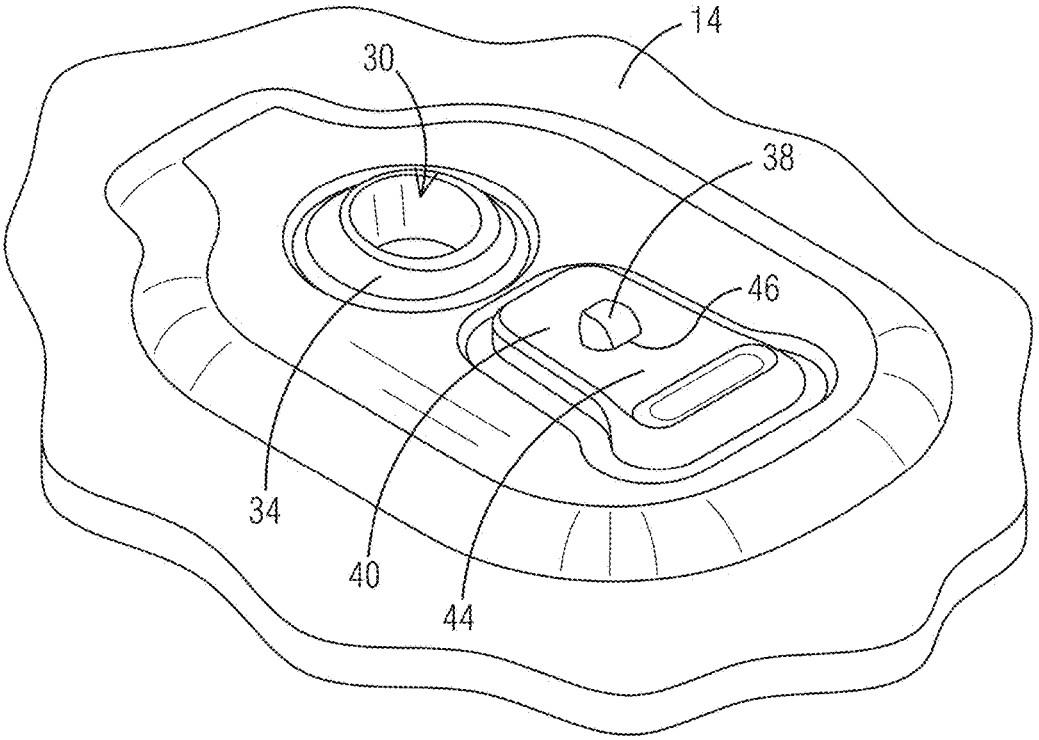
FIG. 13 is a detail bottom perspective view of the cover of the food container with valve element attached.

The plug 30 includes a shaft 32 extending from the main panel 24. The plug 30 further includes an enlarged head 34 located at the free end of shaft 32. The length of shaft 32 is at least the depth of aperture 22, such that enlarged head 34 would pass through aperture 22 and by abutment serve to retain the plug 30 within the aperture 22 during a valve closed condition (as shown in FIGS. 1 and 13). The plug 30 could be a separate component mounted upon the main panel 24, but it is preferred that the main panel 24 and plug 30 be formed as a monolithic unit of the same elastic material.

Figure 2:
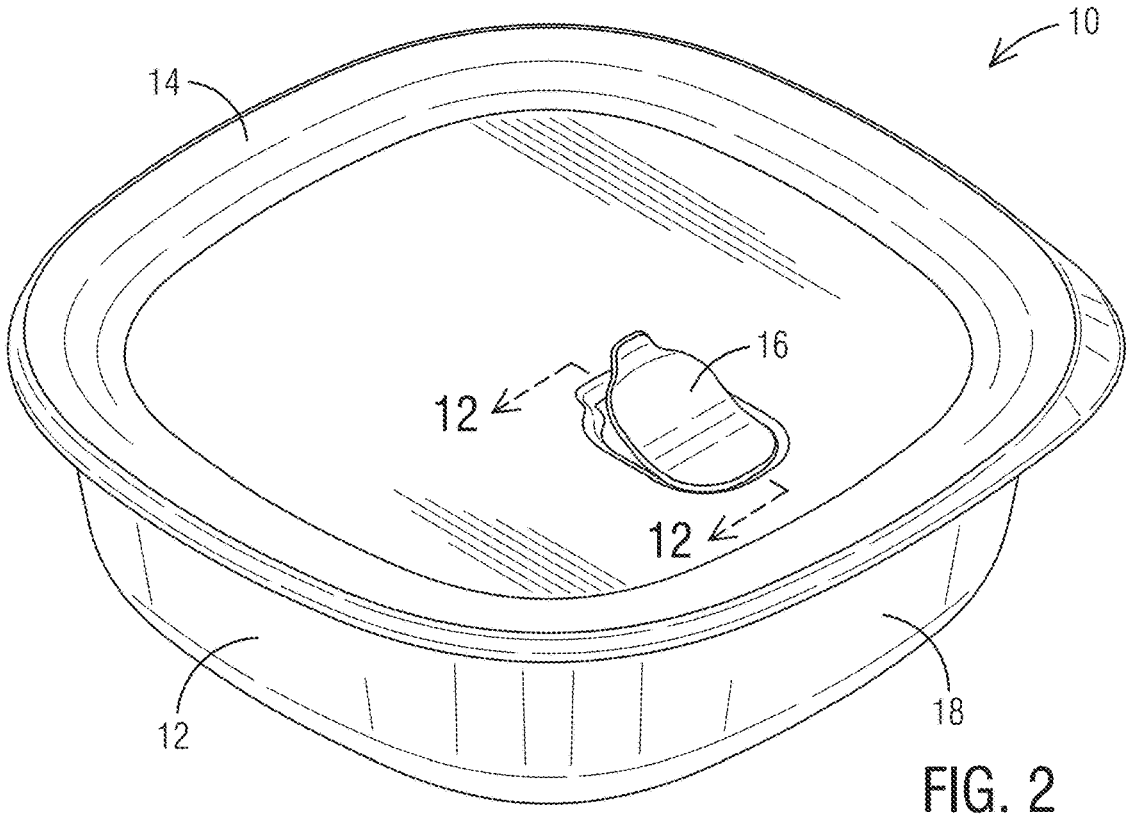
FIG. 2 is a top perspective view of the food container in the valve element in the open position.

A first inventive feature of the present container 10 is that between said first and second sections 26 and 28 the undeformed main panel 24 is created (molded) with an outward curve away from container 10. This is achieved by forming an outward curved section between the first section 26 and the second section 28. With the first section 26 secured to the container 10, and in the undeformed state of the main panel 24, the second section 28 will be spaced from the aperture 22 as illustrated in FIGS. 2 and 12. With this arrangement, the valve open condition of FIGS. 2 and 12 will be readily visually apparent to the user.

A second inventive feature of the present invention is the arrangement to secure the first section 26 to the container 10. This will be described with reference to the connection of the valve element 16 to the cover 14 as illustrated in the drawings. However, it is intended to also encompass the situations where the valve is located in the base 12.

Figure 3:
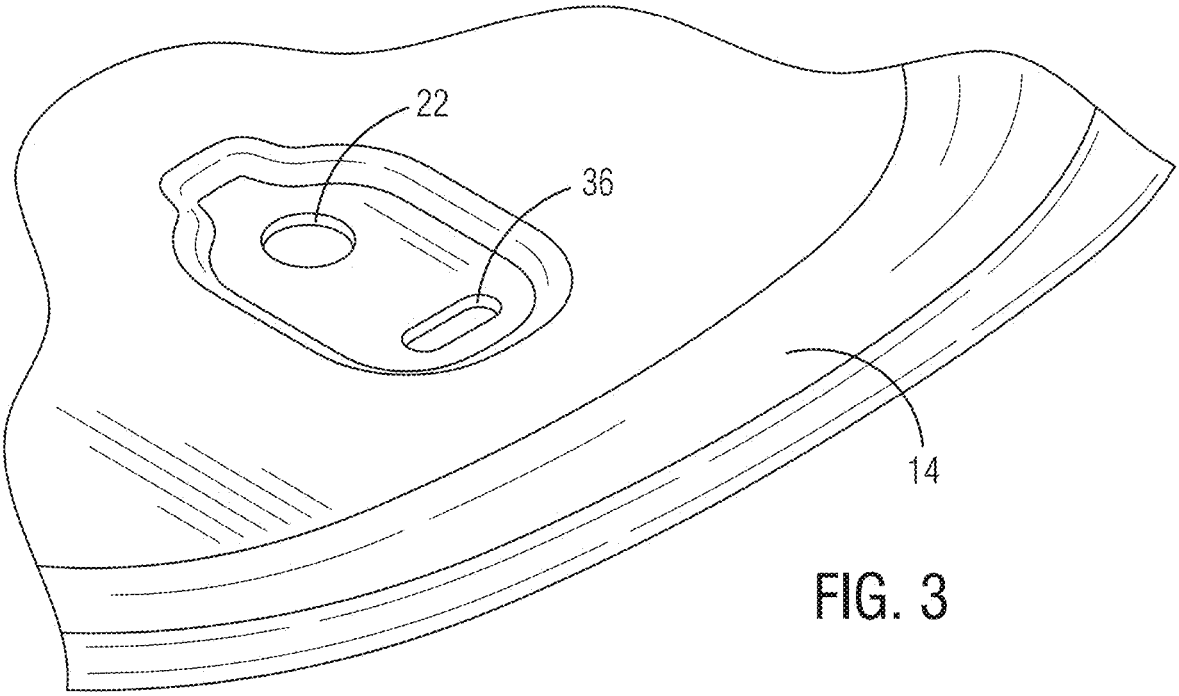
FIG. 3 is a detail top perspective view of the cover of the food container with valve element removed.
Figure 4:
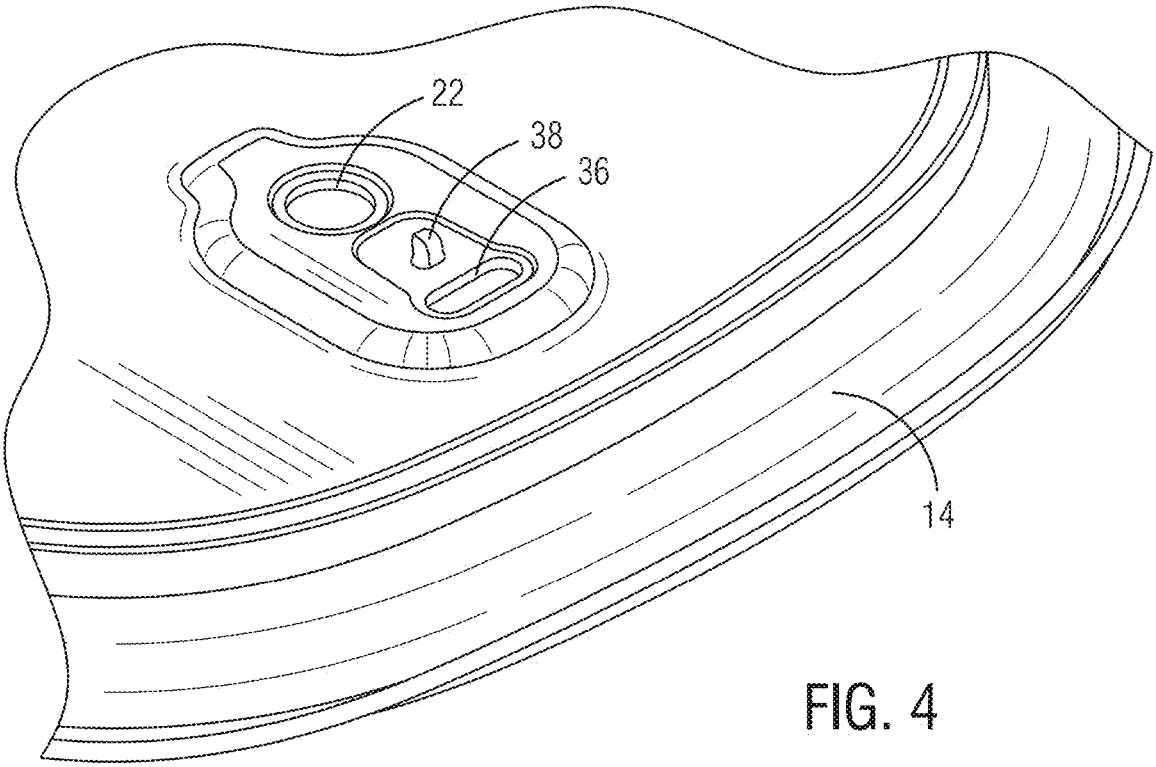
FIG. 4 is a detail bottom perspective view of the cover of the food container with valve element removed.
Figure 5:
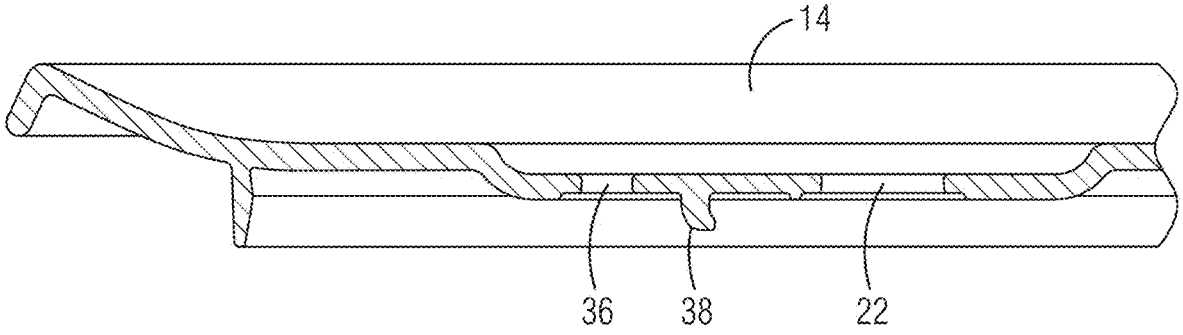
FIG. 5 is a detailed cross-sectional view a long line 5-5 of FIG. 3.
Figure 6:
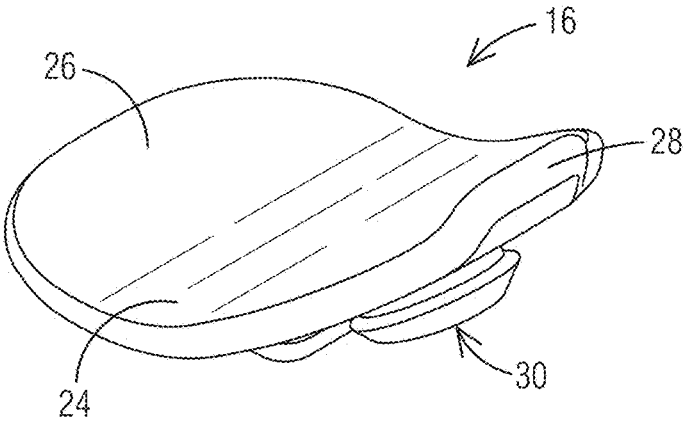
FIG. 6 is a top perspective view of a valve element in the undeformed condition.
Figure 7:
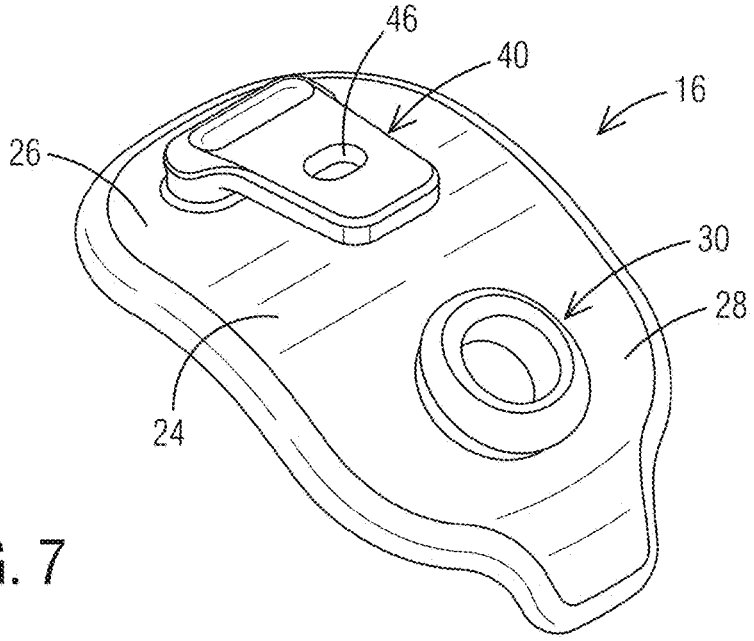
FIG. 7 is a bottom perspective view of the valve element of FIG. 6.
Figure 8:
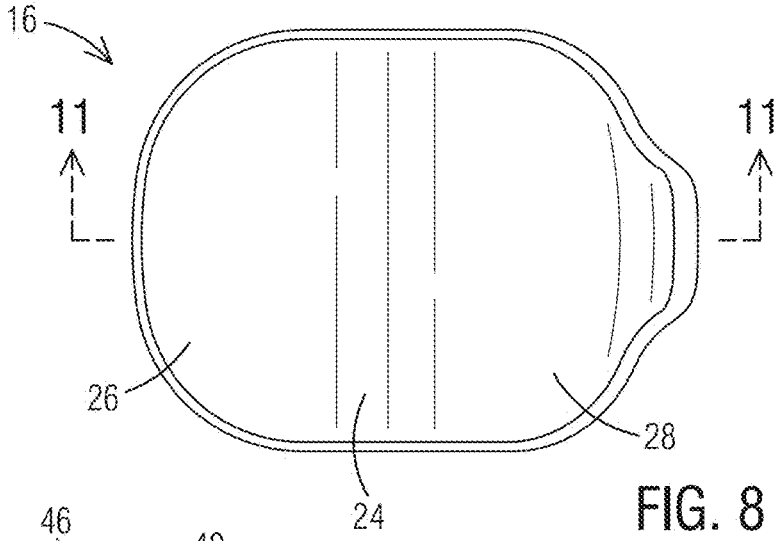
FIG. 8 is a top view of the valve element of FIG. 6.
Figure 9:
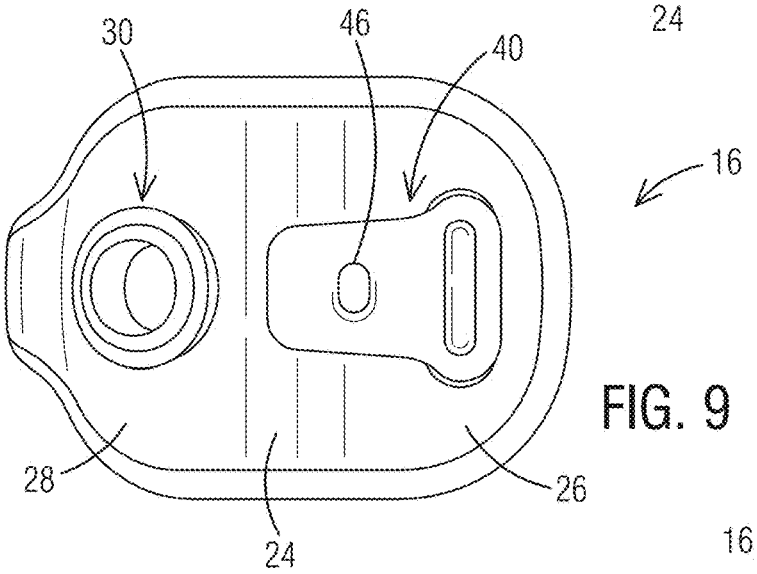
FIG. 9 is a bottom view of a valve element of FIG. 6.
Figure 10:
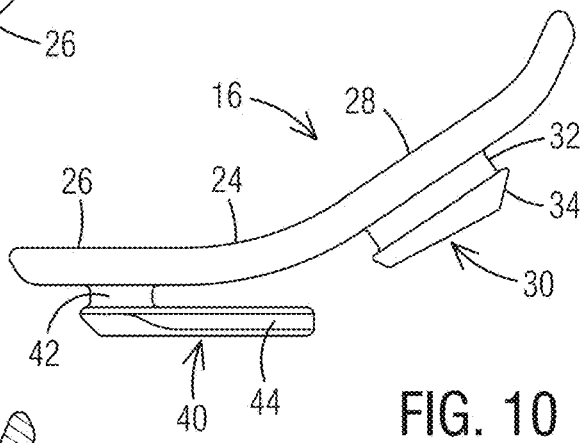
FIG. 10 is a right side view of a valve element of FIG. 6.
Figure 11:
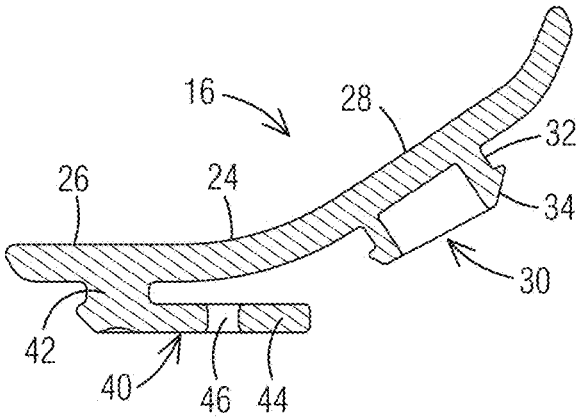
FIG. 11 is a cross-sectional view a long line 11-11 of FIG. 8.

With reference to FIGS. 3-5 (where the valve element 16 and gasket 20 are both removed for clarity) it may be seen that cover 14 includes the aperture 22. As noted, the first section 26 will be secured to the cover 14 near to but spaced from the aperture 22. To that end, there is formed a tab slot 36 extending through the cover 14 at a position near to but spaced from the aperture 22. As best shown in FIGS. 4 and 5, the interior of the cover 14 further includes a lock prong 38 extending therefrom at a position intermediate the tab slot 36 and aperture 22. In the preferred form the lock prong 38 may further be curved toward the aperture 22 as shown.

The valve element 16 further includes a locking tab 40 which includes a spacer bar 42 extending generally normal from the second section 28 inward, as well as a lock flap 44 mounted at the free end of spacer bar 42. The lock flap 44 is generally planar, has a thickness and width permitting it to pass through the tab slot 36, and when undeformed extends roughly parallel to the first section 26. The lock flap 44 includes a lock aperture 46 located at a position offset from the spacer bar 42 a distance corresponding to that of the lock prong 38 from tab slot 36.

As best illustrated in FIGS. 12 and 13, the valve element 16 may be secured to the cover 16 by inserting the free end of lock flap 44 into tab slot 36. Continued insertion will cause the lock flap 44 to pass completely through the tab slot 36. Continued insertion with slight rotation of the valve element will cause spacer bar 42 to enter the tab slot 36. At full insertion of the spacer bar 42 into tab slot 36 the interior face of the main panel 24 will abut or be closely adjacent to the outer face of cover 14. The lock flap 44 will now be adjacent the interior face of the cover 14 and extending towards aperture 22. Further, the lock prong 38 will be near the lock aperture 46. Manual pressure on (perhaps with tugging the free end of) the lock flap 44 will cause the lock aperture 46 to pass over and receive the lock prong 38 as best shown in FIG. 13. In this manner, the valve element 16, and in particular the first section 26 thereof, will be secured to the container 10. While the locking tab 40 may be a separate element mounted on the main panel 24, it is preferred that it be a monolithic extension of the main panel and be formed of the same elastic material.

Figure 14:
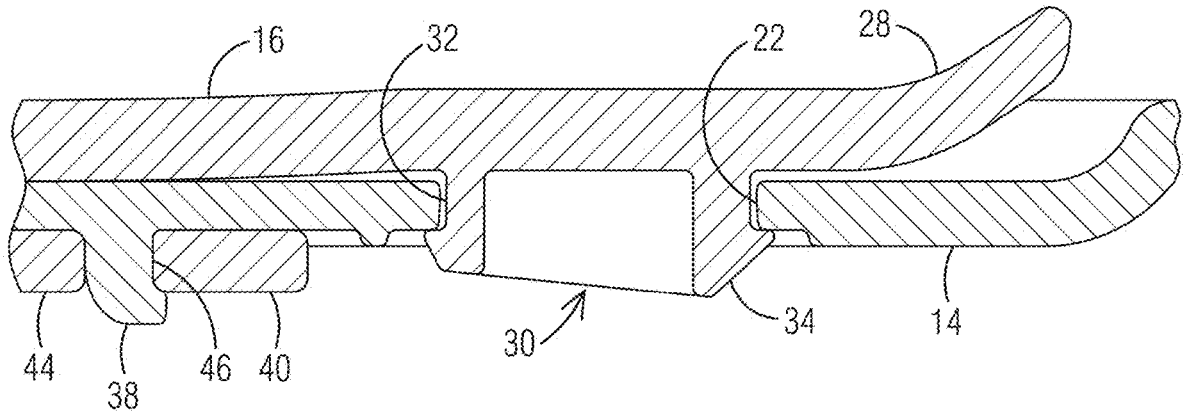
FIG. 14 is a detailed cross-sectional view a long line 14-14 of FIG. 1 showing the valve element in the closed position.

As may be seen by comparison of FIGS. 12-14, in the undeformed state the main panel 24 will extend outward from the container 10 with the plug 30 spaced from the aperture 22. This is the valve open condition of the container 10, and it is readily visually apparent due to the valve element extending outward form the container 10. The main panel 24 may be manually pressed inward to force the plug 30 to enter the aperture 22 and be lodged therein by engagement of the head 34 with the inner face of the container adjacent the aperture 22. This is the valve closed condition of the container 10. As may be seen, in the valve closed condition the fit of the components and the durometer of the elastic material may be tuned to provide a water and/or air tight seal at the aperture 22.

This leads to a third innovative feature, which is automatic underpressure relief. This is achieved in part by proper sizing of the shaft 32 of plug 30. In particular, the diameter of shaft 32 is sized smaller than that of aperture 22. Next, the length of the shaft 32 is sized to be longer than the thickness (or depth) of the aperture 22. As the shaft 32 is both longer than, and smaller than the aperture 22, the shaft 32 may reciprocate within the aperture 22. The amount of reciprocation need not be large, and in fact may be quite small.

Here, it is recalled that the main panel 24 includes the outward curved section between the first section 26 and second section 28. This results in the undeformed main panel being spaced from the container 10, and manual pressure being needed to move the main panel into the valve closed condition of FIG. 14. In other words, the main panel 24 is deformed inward to the valve closed condition, and the elastic strain within the main panel 24 exerts force toward removing the plug 30 from aperture 22. This in turn causes the inner face of head 34 to exert pressure against the container 10 immediately surrounding the aperture 22. In isotropic operation, this serves to increase the strength of the valve closed condition and improve operation of the container 10.

However, it is often the case that the container 10 will operate under varying internal temperatures. One commonly experienced situation is where the food or beverage within container 10 is initially hot, and the container 10 is placed in the valve closed condition. As the food or beverage cools, the internal pressure within container 10 begins to reduce. As is known, continued cooling will lead to an under-pressure within the container 10. This under-pressure may make it difficult to open the container 10, either by removing the cover 14 or by removing plug 30 from aperture 22. The under-pressure can and often does cause deformation of the cover 14, which over extended use may cause sufficient warpage to render the container 10 no longer usable.

Figure 15:
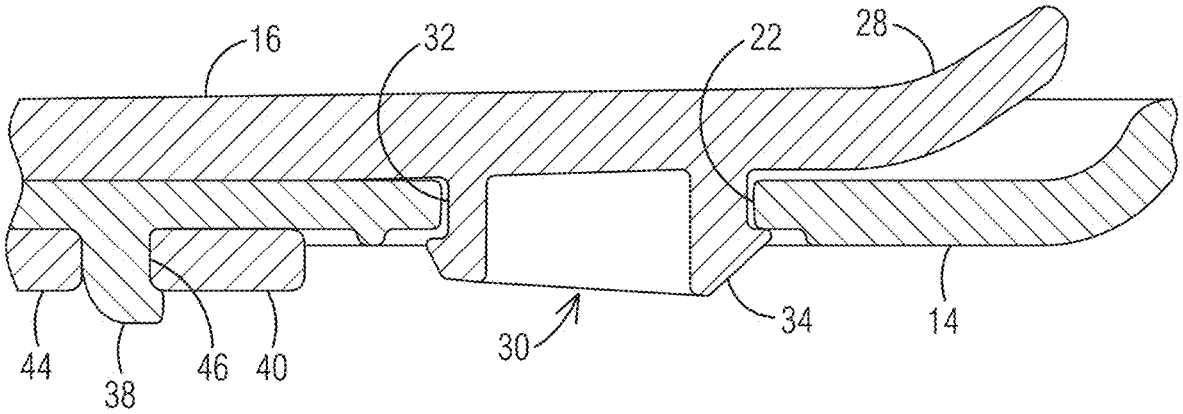
FIG. 15 is a detailed cross-sectional view a long line 14-14 of FIG. 1 showing the valve element in the vent position.

As noted, the sizing of the shaft 32 combined with the elastic nature of the main panel and the curved section between the first and second sections 26 and 28 combine to form a solution to this problem. The operation is illustrated in FIGS. 14 and 15. In FIG. 14 the initial internal pressure within container 10 is at or near atmosphere, so the force of atmosphere pressing inward on the main panel 24 and the force of the internal pressure pushing outward on the plug 30 are relatively balanced. With these pressure forces relatively balanced, the elastic strain within the main panel is dominant and serves to force the head 32 outward to press against the container 10 and form a tight seal preventing ingress or egress of air.

As the food or beverage cools, pressure within container 10 is reduced and this reduces the force outward on the plug 30. Eventually, the force of the atmosphere pressure on the outer face of the main panel 24 will overcome the combined force of internal pressure and the force from elastic strain in the deformed main panel. Because shaft 32 has been sized for reciprocation within the aperture 22, the exterior force of atmosphere will cause the plug 30 to move inward as illustrated in FIG. 15. As may be seen, this movement of the head 34 away from the container 10 will open aperture 22 slightly, and enough for venting of air. This is referred to as the valve vent condition. This valve vent condition will allow ingress of air from atmosphere and an equalization of pressure within the container to or near atmospheric pressure.

This equalization of pressure within the container will once again create an equalization of the forces acting inward and outward on the plug 30. With those forces roughly equalized, the force of elastic strain within the deformed main panel 24 will again become dominant and will move the plug 30 outward. This will once again place the head 32 in abutment with the container 10 adjacent the aperture 22 and restore the valve closed condition. As may be seen, this reduction in internal pressure followed by venting may occur automatically, and as needed, without manual intervention.

From the foregoing it will be seen that this invention is one well adapted to attain all ends and objects set forth above together with the other advantages which are inherent within its structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth of shown in the accompanying drawings is to be interpreted as illustrative, and not in a limiting sense.

What is claimed is:

1. A food container, comprising:

a base for holding food or beverage and including at least one side wall extending upwardly to an upper rim;

a cover sized and shaped to engage said upper rim and define a closed interior;

one of said base or said cover including an aperture extending therethough; and a vent element having a main panel formed of an elastic material and including first and second sections, an inner face of said first section being secured to said one of said base or said cover at a position such that an inner face of said second section may overlie said aperture;

wherein said main panel of said vent element including an outwardly curved section between said first section and said second section, such that in an undeformed state said second section of said main panel is spaced from said container;

wherein said vent element further includes a plug extending therefrom at a position to enter said aperture upon manual inward deformation of said main panel, said plug including a shaft and an enlarged head, wherein said shaft has a diameter less than that of said aperture, and a length greater than a depth of said aperture;

wherein said main panel exerts an outward elastic strain force pressing said head against said one of said base and said cover, and the main panel is designed to allow inward flexing during undesired under-pressure within said container whereby said enlarged head breaks contact with said one of said base and said cover and creates a valve vent condition to relieve said underpressure.

2. A container as in claim 1, wherein in said one of said cover and said base further includes:

a tab slot extending therethrough at a position adjacent to but spaced from said aperture; and a lock prong extending inward from an inner face of said one of said base and said cover, said lock prong being located at a position intermediate said tab slot and said aperture; and wherein said vent element further includes a locking tab including:

a spacer bar extending inward from an inner face of said first section; and a lock flap mounted on a free end of said spacer bar and extending generally parallel to said first section, said lock flap including a lock aperture;

whereby said valve element is secured to said one of said base and said cover by insertion of said lock prong into said tab slot such that said spacer bar is received within said tab slot and said lock flap is in contact with and inner face of said one of said base and said cover, and said lock prong is received within said lock aperture.

3. A food container as in claim 2, wherein said lock flap is a monolithic extension of said valve element.

4. A food container, comprising:

base for holding food or beverage and including at least one side wall extending upwardly to an upper rim;

a cover sized and shaped to engage said upper rim and define a closed interior;

one of said base or said cover including:

an aperture extending therethough;

a tab slot extending therethrough at a position adjacent to but spaced from said aperture; and a lock prong extending inward from an inner face thereof, said lock prong being located at a position intermediate said tab slot and said aperture; and a vent element having a main panel formed of an elastic material and including first and second sections, an inner face of said first section being secured to said one of said base or said cover at a position such that an inner face of said second section may overlie said aperture, said vent element further includes a locking tab including:

a spacer bar extending inward from an inner face of said first section; and a lock flap mounted on a free end of said spacer bar and extending generally parallel to said first section, said lock flap including a lock aperture;

whereby said valve element is secured to said one of said base and said cover by insertion of said lock prong into said tab slot such that said spacer bar is received within said tab slot and said lock flap is in contact with and inner face of said one of said base and said cover, and said lock prong is received within said lock aperture.

5. A food container as in claim 4, wherein said lock flap is a monolithic extension of said valve element.

6. A container as in claim 1, wherein said main panel is formed of silicone.

* * * * *